United States Patent [19]

Russ

[11] 4,282,849

[45] Aug. 11, 1981

[54] BOW AND ARROW HOLDER

[76] Inventor: Dwayne A. Russ, 220 Grace St., Schofield, Wis. 54476

[21] Appl. No.: 113,549

[22] Filed: Jan. 21, 1980

[51] Int. Cl.[3] ..... F41B 5/00

[52] U.S. Cl. ..... 124/23 R; 248/324

[58] Field of Search ..... 124/23 R, 24 R, 41 R, 124/35 A, 90, 86; 248/226.2, 324

[56] References Cited

U.S. PATENT DOCUMENTS

| | | | |
|---|---|---|---|
| 2,201,138 | 5/1940 | Hyde | 248/226.2 X |
| 2,488,597 | 11/1949 | Konold | 124/35 A |
| 4,041,926 | 8/1977 | Troncoso | 124/35 A |
| 4,151,825 | 5/1979 | Cook | 124/35 A |

*Primary Examiner*—Richard C. Pinkham
*Assistant Examiner*—William R. Browne

[57] ABSTRACT

A holder for retaining a hunting bow and an arrow in the ready position is described. The holder is fastened to a strap which in turn is placed over the shoulder of the hunter or to a support, thereby permitting the hunter to release the bow and warm his hands, eat, drink or rest. The bow and arrow holder of the present invention can be quickly released, thereby permitting the hunter to shoot. The holder includes a pair of pivotable plates which lock against the arrow under pressure exerted by the bow string.

10 Claims, 4 Drawing Figures

BOW AND ARROW HOLDER

FIELD OF THE INVENTION

The present invention relates generally to the archery art and more particularly to a device for holding an arrow in the ready position which can be quickly released to permit shooting.

BACKGROUND OF THE INVENTION

Bow and arrow hunters have always been faced with a serious problem, one which is especially encountered in cold weather climates. The problem relates to holding the bow and arrow in the ready position for long periods of time, e.g. the time spent waiting in a hunting blind. If the hunter tries to hold the bow for long periods, fatigue can set in which can not only reduce the enjoyment of a hunting trip but can reduce shooting accuracy due to muscle fatigue. If the hunter decides to rest by putting the bow down, a missed shot may result from the delay in picking up the bow and nocking the arrow or an animal may be spooked due to the movement required to prepare for the shot.

As mentioned above, these problems are compounded in cold weather climates where a hunter needs to warm his hands by placing them in his pockets. Also, where snow is encountered, any movement may be more noticeable to the prey.

One solution to the problems just described is a bow holder which includes a strap secured around a tree trunk or limb with a fork-shaped element designed to grasp the end of a bow and hold it in an upright position. The seller of this type of bow holder indicates that an arrow can be nocked while the bow is being held by the holder, but the holder does not hold the arrow itself and the arrow can be unnocked during the movement required to disengage the bow from the forked-shaped clasp element. Moreover, this type of holder is only useful if a limb is located adjacent to the blind and is not useful in situations where the hunter is walking or standing in an open location. An improved bow and arrow holder would be a significant advance in this technology.

OBJECTS OF THE INVENTION

It is a primary object of the present invention to provide a bow and arrow holder which both holds the bow and secures an arrow in the nocked position.

Another object of the present invention is to provide a bow and arrow holder which can be quickly released to permit shooting.

A further object of the present invention is to provide a bow and arrow holder which can be fastened to the hunter or to a support adjacent the hunter.

A still further object of the present invention is to provide a bow and arrow holder which can be used on bows of different designs.

How these and other objects of the present invention are accomplished will be described in the following specification taken in conjunction with the drawings. Generally, however, they are accomplished by a bow and arrow holder which comprises a first plate member having a strap affixed to one end. A pair of holder elements are pivotably secured to the other end of the plate member, each of the elements being generally triangular in shape and having a curled side. The strap is secured over the hunter's shoulder or to a tree while the elements are spread to receive an arrow. When the arrow is nocked, the string of the bow presses against one corner of each holder element forcing an adjacent corner against the nock of the arrow to secure it in place. The bow and arrow are therefore held in the ready position.

DESCRIPTION OF THE PREFERRED EMBODIMENT

Figure 1:
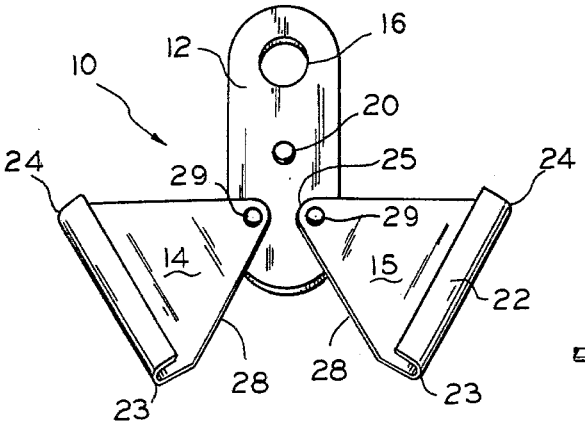
FIG. 1 is a front perspective view of the bow and arrow holder of the present invention with the holder elements in the open position.

FIG. 1 shows the preferred embodiment of the bow and arrow holder 10 of the present invention to include an elongate plate member 12 and a pair of holder elements 14 and 15. Plate member 12 has generally rounded ends and includes a hole 16 adjacent one end. Plate member 12 also includes a grip element 18 (see FIG. 3), element 18 being a right angle piece of metal, secured to the back side of plate member 12 by rivet 20. Of course, any suitable means, such as welding, can be used for attaching these two components of bow and arrow holder 10.

Holder elements 14-15 are each generally triangular in shape and include an upturned curled side 22 between corners 23 and 24. Adjacent the third corner 25 a hole is provided for pivotably securing the holder elements 14-15 to plate element 12, such as by rivet members 29. The rivets 29 are spaced apart adjacent the end of plate member 12 opposite from hole 16, thereby permitting corners 23 to be rotated about an arc to a closed position shown in FIG. 2-3 where sides 28 of holder elements 14 are substantially parallel.

Figure 2:
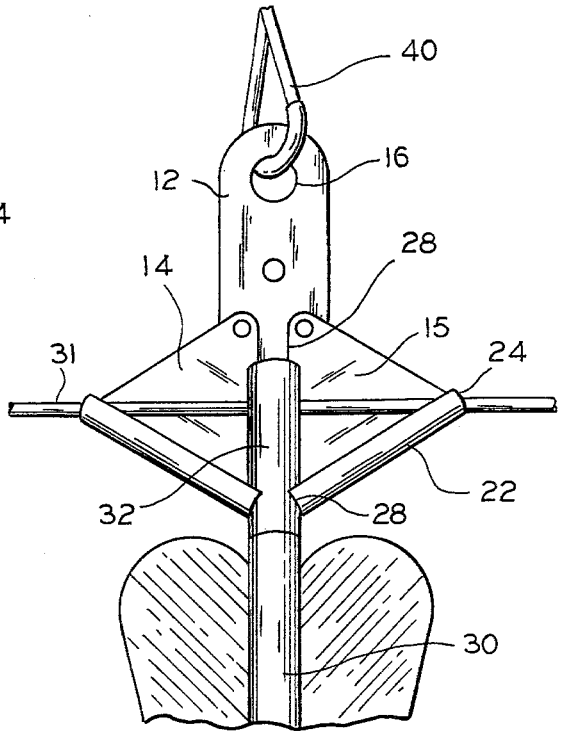
FIG. 2 is a front perspective view of the bow and arrow holder of the present invention with an arrow retained in place by the holder elements.

The placement of elements 14 and 15, the curvature of side 22 and the overall dimensions of the holder elements are selected to accomplish the result shown in FIG. 2, i.e. to hold an arrow 30 in a nocked position on bow string 31. From this FIGURE it will be appreciated that when nock 32 is placed around the string and the holder 10 is put into position, the string 31 will contact corners 24 of the elements 14 and 15 forcing the elements to their closed positions and causing corners 23 to press against the nock 32. Curved edge 22, at corner 23, contacts the round nock and should therefore have a curvature similar to that of the arrow.

FIG. 2 also shows a snap 40 coupled to hole 16, the snap in turn being coupled to a suitable strap (not shown). The strap can be a shoulder strap or can be secured to a tree trunk, limb or a support of a hunting blind if desired.

Figure 3:
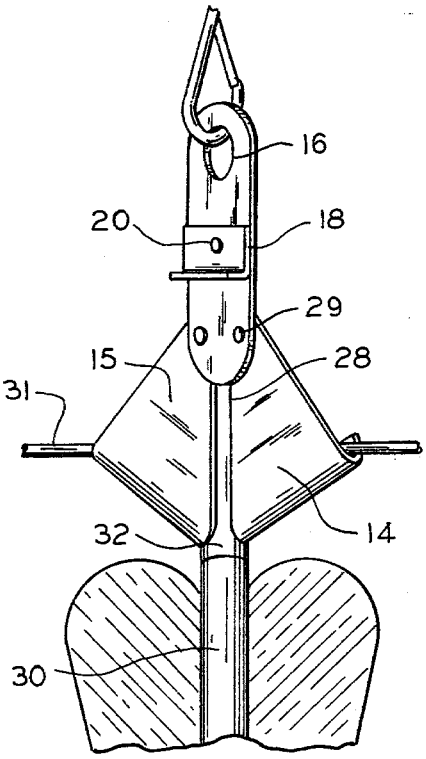
FIG. 3 is a back view of the bow and arrow holder of the present invention with an arrow held in place by the holder elements.
Figure 4:
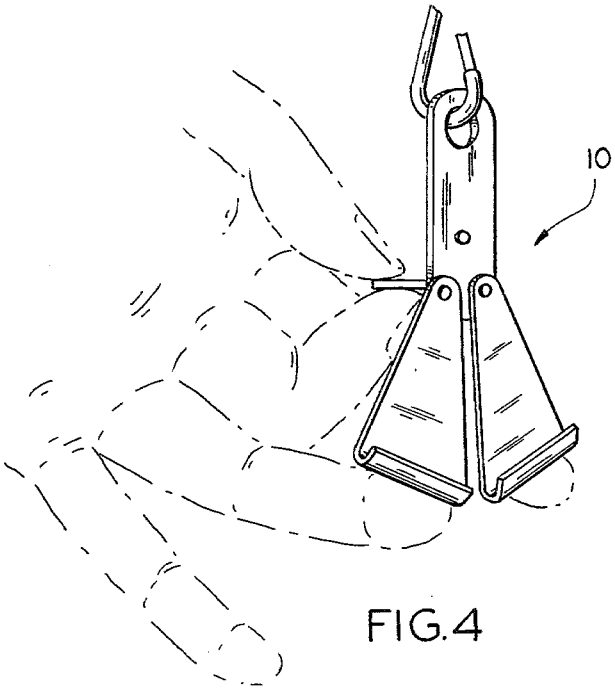
FIG. 4 is a perspective view of the holder of the present invention and showing the hand position used for releasing the holder elements.

By reference to FIGS. 3 and 4, it will be appreciated how holder 10 is released when the hunter is ready to shoot. By grasping grip element 18 with the thumb and middle finger and using the index and ring fingers to spread the holder elements 14 and 15, holder 10 may quickly be removed. Once elements 14 and 15 are spread apart, the holder 10 is pivoted slightly around the bow string to accomplish removal.

While the preferred material for constructing holder 10 is metal, plastics can also be used. Moreover, holder elements 14 and 15 may be coated with a resin material or the like, especially at corners 23 and 24 to prevent damage to the bow string or nock 32 of arrow 30. It should also be appreciated that holder 10 may be used with a wide variety of different bows since the holder does not engage the bow itself. Also, holder 10 may be prepared in a variety of sizes if different size arrows are employed. So while the bow and arrow holders of the present invention has been described by reference to the preferred embodiment shown in the four drawings, it is not to be limited thereby but is limited solely by the claims which follow.

I claim:

1. A holder comprising a first support plate member and a pair of generally triangular holder element means for pivoting to a bow string and arrow receiving position, each of said element means having a first corner and a first opposed edge, said first corner of each element being pivotably secured to a first side of said plate member and said first opposed edges being curled upwardly from the plane of said holder elements for receiving a bow string and a locked end of an arrow, said holder elements being arranged on said plate member whereby second edges of said holder elements are adjacent to a parallel to one another when said elements are in a first closed position to receive a bow string and an arrow.

2. The invention set forth in claim 1 wherein said plate member is elongate and includes a hole at the end thereof remote from said element means.

3. The invention set forth in claim 2 wherein a strap is attached to said plate member through said hole.

4. The invention set forth in claim 1 wherein said holder also includes a grip element secured to said plate member on the side thereof opposite from said holder elements.

5. The invention set forth in claim 4 wherein said grip element comprises a base secured to said plate members and a flange perpendicular thereto.

6. A bow and arrow holding system including a bow having a bow string and an arrow nocked thereto, a holder having a first support plate member and a pair of generally triangular holder element means for pivoting to a bow string and arrow receiving position, each of said element means having a first corner and an opposed edge, said first corner of each element means being pivotably secured to a first side of said plate member and said opposed edge being curled upwardly from the plane of said holder element means, each said holder element means being arranged on said plate member whereby second edges of said holder elements are adjacent to and parallel to one another when both said element means are in a first bow string and arrow receiving closed position, said holder element means holding said arrow in said nocked position by said bow string contacting a second corner of each of said holder element means and urging each said holder element means toward said first closed position and a third corner of each of said holder element means contacting the nock of said arrow and holding same.

7. The invention set forth in claim 6 wherein said plate member is elongate and includes a hole at the end thereof remote from each said element means.

8. The invention set forth in claim 7 wherein a strap is attached to said plate member through said hole.

9. The invention set forth in claim 6 wherein said bow and arrow holder also includes a manual grip element secured to said plate member on the side thereof opposite from said holder element means.

10. The invention set forth in claim 9 wherein said grip element comprises a base secured to said plate member and a flange perpendicular thereto.

* * * * *